US010746013B2

(12) United States Patent
Hohl

(10) Patent No.: US 10,746,013 B2
(45) Date of Patent: Aug. 18, 2020

(54) DOWNHOLE TEST SIGNALS FOR IDENTIFICATION OF OPERATIONAL DRILLING PARAMETERS

(71) Applicant: Andreas Hohl, Hannover (DE)

(72) Inventor: Andreas Hohl, Hannover (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 267 days.

(21) Appl. No.: 14/725,621

(22) Filed: May 29, 2015

(65) Prior Publication Data

US 2016/0348493 A1 Dec. 1, 2016

(51) Int. Cl.

| | |
|---|---|
| ***G06G 7/48*** | (2006.01) |
| ***E21B 44/04*** | (2006.01) |
| ***E21B 21/08*** | (2006.01) |
| ***E21B 47/00*** | (2012.01) |
| ***E21B 4/02*** | (2006.01) |
| ***F04C 2/107*** | (2006.01) |
| ***F04C 13/00*** | (2006.01) |
| ***F04C 14/08*** | (2006.01) |
| *G06G 7/50* | (2006.01) |

(52) U.S. Cl.

CPC ..... *E21B 44/04* (2013.01); *E21B 4/02* (2013.01); *E21B 21/08* (2013.01); *E21B 47/0006* (2013.01); *F04C 2/107* (2013.01); *F04C 13/008* (2013.01); *F04C 14/08* (2013.01); *F04C 2/1075* (2013.01); *F04C 2240/81* (2013.01); *F04C 2270/125* (2013.01); *F04C 2270/80* (2013.01); *F04C 2270/86* (2013.01)

(58) Field of Classification Search

CPC ..... E21B 4/02; E21B 44/04; E21B 47/0006; F04C 2/107; F04C 13/008; F04C 14/08; G05B 17/02; G06F 17/50

USPC ..... 703/9, 10

See application file for complete search history.

(56) References Cited

U.S. PATENT DOCUMENTS

| | | | | |
|---|---|---|---|---|
| 6,021,377 | A | 2/2000 | Dubinsky et al. | |
| 8,775,085 | B2 | 6/2014 | Reckmann et al. | |
| 2005/0096847 | A1 * | 5/2005 | Huang | E21B 44/00 702/9 |
| 2006/0266913 | A1 | 11/2006 | McCoy et al. | |

(Continued)

OTHER PUBLICATIONS

Craig, R. R. ; Bampton, M. C. C.: "Coupling of Substructures for Dynamic Analyses." In: AIAA Journal 6 (1968), Nr. 7, S. 1313-1319. 7 pages.

(Continued)

*Primary Examiner* — Andre Pierre Louis
(74) *Attorney, Agent, or Firm* — Cantor Colburn LLP

(57) ABSTRACT

A method for selecting drilling parameters for drilling a borehole penetrating the earth with a drill string includes: varying a frequency of an excitation force applied to the drill string using an excitation device controlled by a drill string controller and measuring vibration-related amplitudes of the drill string due to the applied excitation force using a vibration sensor to provide amplitude measurements. The method further includes determining one or more modal properties comprising one or more eigenfrequencies of the drill string using the amplitude measurements and selecting drilling parameters that apply an excitation force at a frequency that avoids a selected range of frequencies that bound the one or more eigenfrequencies.

21 Claims, 7 Drawing Sheets

(56) References Cited

U.S. PATENT DOCUMENTS

| | | | | |
|---|---|---|---|---|
| 2007/0017672 | A1 | 1/2007 | Kayadarma | |
| 2010/0052941 | A1* | 3/2010 | Madhavan | E21B 4/02 340/854.8 |
| 2011/0077924 | A1* | 3/2011 | Ertas | E21B 7/00 703/2 |
| 2012/0123757 | A1 | 5/2012 | Ertas et al. | |
| 2013/0088468 | A1* | 4/2013 | Sakakura | G11C 19/184 345/204 |
| 2013/0277116 | A1* | 10/2013 | Knull | E21B 4/003 175/57 |
| 2015/0083492 | A1* | 3/2015 | Wassell | E21B 44/00 175/24 |
| 2016/0245064 | A1* | 8/2016 | Wiercigroch | E21B 44/005 |

OTHER PUBLICATIONS

Dykstra, Mark William; "Nonlinear Drill String Dynamics"; The University of Tulsa; (1996). 282 pages.

Notification of Tranmittal of the International Search Report and the Written Opinion of the International Searching Authority, or the Declaration; PCT/US16/034927; dated Sep. 9, 2016; 11 pages.

* cited by examiner

DOWNHOLE TEST SIGNALS FOR IDENTIFICATION OF OPERATIONAL DRILLING PARAMETERS

BACKGROUND

Boreholes are drilled into the earth for many applications such as hydrocarbon production, geothermal production, and carbon dioxide sequestration. In general, the boreholes are drilled using a drill bit disposed on the distal end of a drill string.

Severe vibrations in drill strings and associated bottom-hole assemblies can be caused by cutting forces at the bit or mass imbalances in downhole tools such as mud motors. Vibrations can be differentiated into axial, torsional and lateral direction. Negative effects due to the severe vibrations are among others reduced rate of penetration, reduced quality of measurements and downhole failures. Hence, improvements in drill string operations that prevent severe vibrations would be appreciated in the drilling industry.

BRIEF SUMMARY

Disclosed is a method for selecting drilling parameters for drilling a borehole penetrating the earth with a drill string. The method includes: varying a frequency of an excitation force applied to the drill string using an excitation device controlled by a drill string controller; measuring vibration-related amplitudes of the drill string due to the applied excitation force using a vibration sensor to provide amplitude measurements; determining with a processor one or more modal properties comprising one or more eigenfrequencies of the drill string using the amplitude measurements; and selecting drilling parameters that apply an excitation force at a frequency that avoids a selected range of frequencies that bound the one or more eigenfrequencies using the processor.

Also disclosed is another method for selecting drilling parameters for drilling a borehole penetrating the earth with a drill string. This method includes: constructing a mathematical model of the drill string comprising dimensions and mass distribution of the drill string; analyzing a response of the mathematical model to an excitation stimulus to provide the modal shape of the drill string; determining a location of one or more nodes of the modal shape; disposing a plurality of vibration sensors at locations along the drill string that are not nodes of the modal shape; varying a frequency of excitation forces applied to the drill string using a plurality of excitation devices, the excitation forces being applied simultaneously, sequentially or some combination thereof; measuring amplitudes of vibrations of the drill string due to the applied excitation forces using the plurality of vibration sensors to provide amplitude measurements; determining with a processor one or more modal properties comprising one or more eigenfrequencies of the drill string using the amplitude measurements; applying a correction factor as determined by the analysis of the mathematical model to the measured amplitudes to determine a maximum amplitude of vibration of the drill string; selecting drilling parameters that apply an excitation force at a frequency that avoids a selected range of frequencies that bound the one or more eigenfrequencies using the processor; and transmitting the selected drilling parameters to a drill string controller configured to control the drill string in accordance with the selected drilling parameters.

Further disclosed is an apparatus for selecting drilling parameters for drilling a borehole penetrating the earth with a drill string. The apparatus includes: an excitation device configured to vary a frequency of an excitation force applied to the drill string; a drill string controller configured to operate the excitation device in order to vary the frequency of the excitation force; a vibration sensor configured to measure amplitudes of vibrations of the drill string due to the applied excitation force to provide amplitude measurements that are in a time domain and/or a frequency domain; and a processor configured to (i) determine one or more modal properties comprising one or more eigenfrequencies of the drill string using the amplitude measurements, (ii) select drilling parameters that apply an excitation force at a frequency that avoids a selected range of frequencies that bound the one or more eigenfrequencies and (iii) transmit the selected drilling parameters to a drill string controller configured to control the drill string in accordance with the selected drilling parameters.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Disclosed are method and apparatus for selecting a drilling parameter for drilling a borehole with a drill string. The selected drilling parameter or parameters (e.g., string RPM, bit RPM, WOB, and the like) reduce or mitigate vibrations and thus improve the rate of penetration and reduce the risk of equipment damage. Consequently, boreholes may be drilled more efficiently and cost effectively. The method and apparatus vary an excitation frequency of a stimulus applied to the drill string. The excitation frequency may include multiple frequencies applied simultaneously, sequentially or some combination thereof. Similarly, the stimulus may include multiple stimuli or multiple stimulation sources. The resulting amplitudes of vibrations due to one stimulus or multiple stimuli are measured by one or more sensors. The vibrations may be lateral, axial and/or torsional. From the amplitudes and/or phase information, vibrational characteristics of the drilling system such as modal properties (e.g., one or more eigenfrequencies, modal damping factors, mode shapes or stability factors) are identified. Operational drilling parameters are then selected to avoid severe vibrations induced by an excitation source that may damage the drilling system. The severe vibrations may result from a resonance in the drilling system where the excitation frequency equals an eigenfrequency. The selected operational parameters in one or more embodiments may be transmitted automatically to a controller for controlling the drilling parameters while a borehole is being drilled, thus, avoiding severe vibrations of the drill string.

Figure 1:
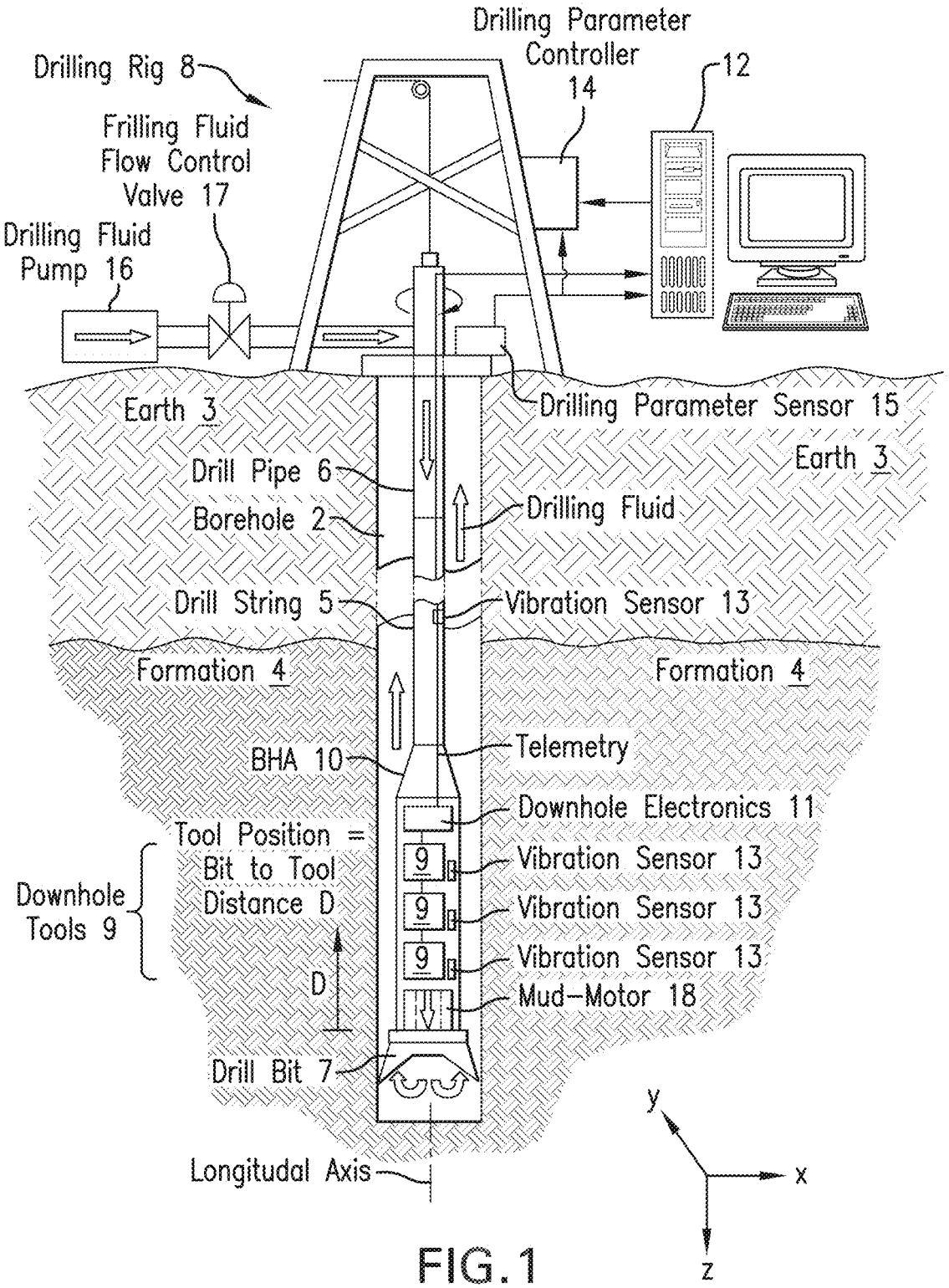
FIG. 1 illustrates a cross-sectional view of an embodiment of a drill string disposed in a borehole penetrating the earth.

FIG. 1 illustrates a cross-sectional view of an exemplary embodiment of a drill string 5 disposed in a borehole 2 penetrating the earth 3. The earth 3 may include an earth formation 4, which may represent any subsurface material of interest that the borehole 2 may traverse. The drill string 5 in the embodiment of FIG. 1 is a string of coupled drill pipes 6, however, the drill string 5 may represent any drill tubular subject to vibrations due to an imbalance. The drill tubular 5 includes a drill bit 7 disposed at the distal end of the drill string 5. The drill bit 7 is configured to be rotated by the drill tubular 5 to drill the borehole 2. Also disposed at the distal end of the drill string 5 is a bottomhole assembly (BHA) 10. The BHA 10 may include the drill bit 7 as illustrated in FIG. 1 or it may be separate from the BHA 10. A drill rig 8 is configured to conduct drilling operations such as rotating the drill string 5 and thus the drill bit 7 in order to drill the borehole 2. In addition, the drill rig 8 is configured to pump drilling fluid through the drill string 5 in order to lubricate the drill bit 7 and flush cuttings from the borehole 2. A mud-motor 18 is configured to convert the energy of flowing drilling fluid to rotational energy to provide further rotational energy to the drill bit 7 and may also be included in the BHA 10. In the embodiment of FIG. 1, the drill tubular 5 includes a borehole wall interaction component 16 that is configured to interact with or contact a wall of the borehole 2. As the drill string 5 may include a BHA, a drill bit, a mud-motor and/or other drill string devices or tools, the term "drill string" may be inclusive of these components.

The BHA 10 in FIG. 1 is configured to contain or support a plurality of downhole tools 9. The downhole tools 9 represent any tools that perform a function downhole while drilling is being conducted or during temporary halt in drilling. In one or more embodiments, the function represents sensing of formation or borehole properties, which may include caliper of borehole, temperature, pressure, gamma-rays, neutrons, formation density, formation porosity, resistivity, dielectric constant, chemical element content, and acoustic resistivity, as non-limiting embodiments. In one or more embodiments, the downhole tools 9 include a formation tester configured to extract a formation fluid sample for surface or downhole analysis and/or to determine the formation pressure. In one or more embodiments, the downhole tools 9 may include a geo-steering device configured to steer the direction of drilling.

Drilling parameters of the drill rig, such as drill string rotational speed (e.g., rpm), weight-on-bit (WOB) and drilling fluid flow rate, are controlled by a drilling parameter controller 14. The drilling parameter controller 14 is configured to (1) vary a frequency of a drilling parameter and thus an excitation frequency (may include multiple frequencies applied simultaneously or sequentially) upon receiving a corresponding signal from a processing system 12 and (2) provide feedback control of a drilling parameter upon receiving a corresponding signal having a control setpoint from the processing system 12. A drilling parameter sensor 15 configured to sense a value of drilling parameter is used to provide feedback input to the drilling parameter controller 14 for feedback control. The drilling parameter sensor 15 also provides input to the processing system 12 so that the processing system 12 can analyze measured amplitudes and/or phase information to determine drilling parameter values as the frequency of the drilling parameter is varied. Analysis may include determining amplitude peaks and drilling parameter frequencies at which the peaks occur. Varying a frequency of a drilling parameter may also include varying a physical property of a tool such as cutter exposure of the drill bit or operational characteristics of a jar.

Figure 2:
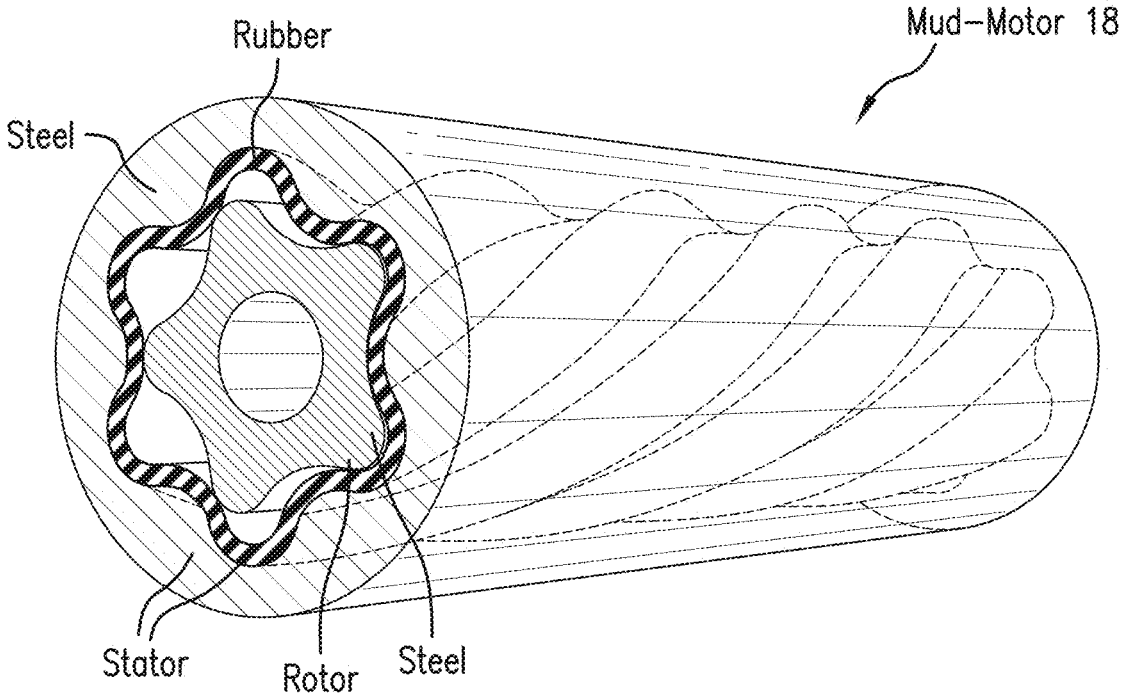
FIG. 2 depicts aspects of a mud-motor.

In general, the drilling parameters that have a corresponding frequency varied by the drilling parameter controller are those drilling parameters that have an imbalance or other effects such as shaft bow that will cause drill string vibrations. One example is the drill pipes themselves, which may have a mechanical imbalance due to manufacturing imperfections or wide manufacturing tolerances. Imbalanced drill pipes may result in lateral vibrations when rotated by a top-drive. In another example, the mud-motor 18 may include a stator with a plurality of lobes and a rotor having fewer lobes than the rotor as illustrated in FIG. 2. The mud-motor 18 in FIG. 2 includes a stator having six lobes and a rotor having 5 lobes that are configured to interlock with the rotor lobes while rotating. The configuration may be referred to as a 5/6 lobe mud-motor. Mud-motors of this type may be inherently imbalanced and thus may cause lateral vibrations while in operation. The stator is connected to the drill string and is rotating with the rotary speed provided by the top-drive (string speed). The rotor is driven by the flow of the drilling fluid (mud). The lobe configuration has an impact on the rotational speed and the torque that can be provided by the mud motor. For a given flow rate and pitch of rotor and stator, the motor torque is approximately proportional to the number of lobes. Contrary, the rotational speed changes approximately inversely proportionally with the number of lobes. Following, the rotational speed is decreasing with the number of lobes for a given flow rate. If the stator is rotating, the rotor is acting as an imbalance and the excitation frequency is $-f_{string}$. If the string/stator is not rotating and the motor is driven by the flow of the mud, the rotor is turning in the clockwise direction. The center of mass of the rotor in a stator fixed coordinate system, however, is rotating in the counter-clockwise direction. The rotational speed $zf_{motor}$ of the center of mass is dependent on the number of lobes z and the motor speed. The excitation frequency, $f_{exc}=zf_{motor}-f_{string}$, of a mud motor is then dependent on the rotary speed of the string $f_{string}$, the rotary speed of the mud motor $f_{motor}$ and the number of lobes z of the rotor.

Other examples of drill string device that may cause drill string vibrations are a jar (not shown), which provides impact excitation over a broad frequency range, and an agitator (not shown), which causes harmonic vibrations in the axial direction. The other examples may include intentionally designed tools for providing impact forces and vibrations, harmonic vibrations, sine wave sweep and/or any kind of excitation force and frequency.

Referring back to FIG. 1, downhole electronics 11 may be configured to operate one or more tools in the plurality of downhole tools 9, process measurement data obtained downhole, and/or act as an interface with telemetry to communicate measurement data or commands between downhole components and the computer processing system 12 disposed at the surface of the earth 3. Non-limiting embodiments of the telemetry include pulsed-mud and wired drill pipe. System operation and data processing operations may be performed by the downhole electronics 11, the computer processing system 12, or a combination thereof. A processor such as in the computer processing system 12 may be used to implement the teachings disclosed herein.

In the embodiment of FIG. 1, a plurality of vibration sensors 13 are disposed in the BHA 10 and along the drill string 5. In other embodiments one or more vibration sensors 13 may be at one location or at multiple locations on the drill string. Each vibration sensor 13 is configured to measure an amplitude of vibration or acceleration either laterally, axially, and/or torsionally, an amplitude of deflection, an amplitude of velocity, and/or an amplitude of a bending moment. The plurality of vibration sensors are configured to provide sensed amplitudes to the downhole electronics 11 and/or the surface computer processing system 12. In one or more embodiments, each vibration sensor 13 may be an accelerometer configured to measure acceleration in one, two or three dimensions, which may be orthogonal to each other or have vector components that are orthogonal to each other. In one or more embodiments, a vibration sensor 13 may be co-located with one or more downhole tools 9 in order to sense the vibration levels that the tools are experiencing.

Figure 3:
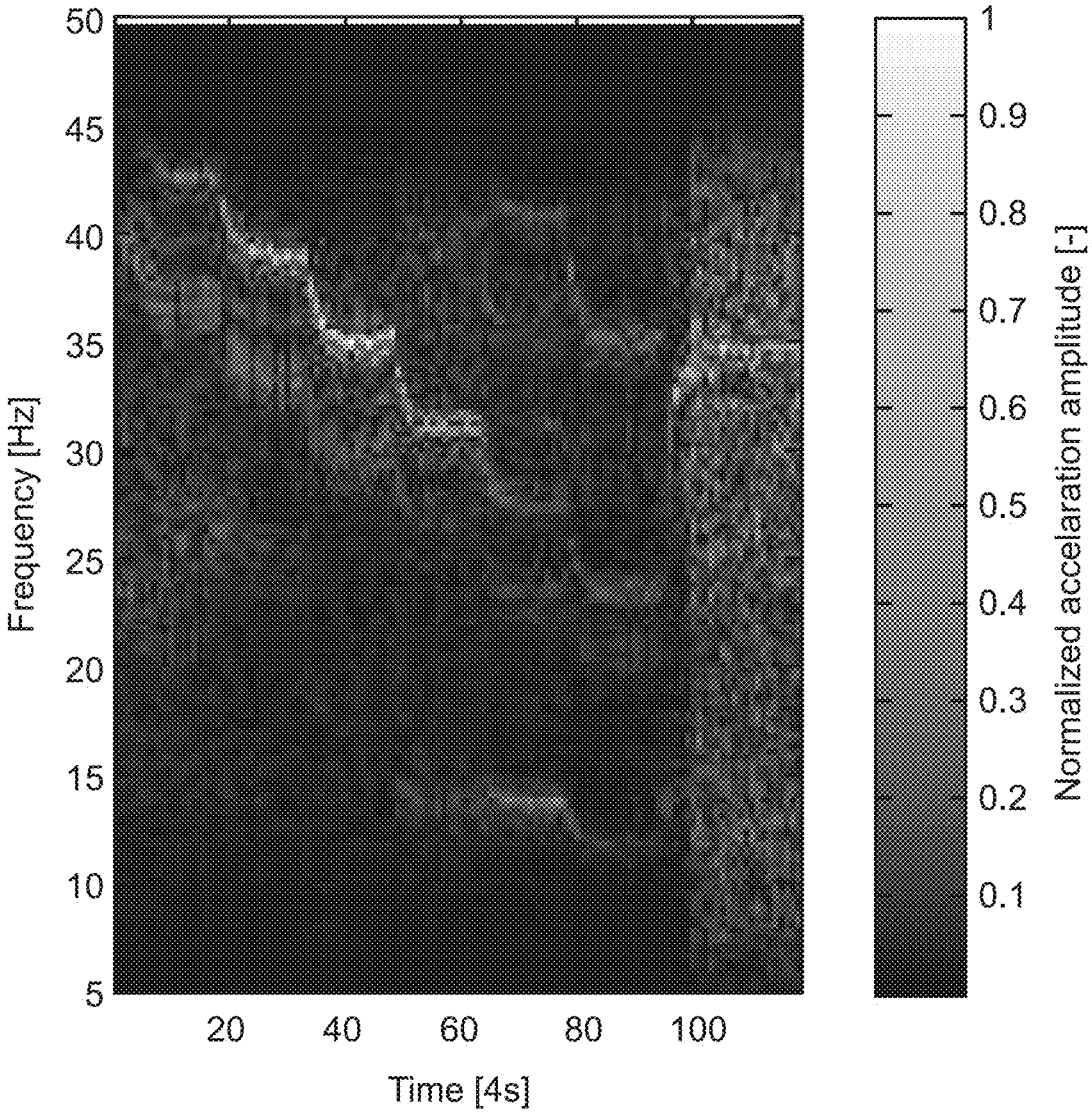
FIG. 3 depicts aspects of varying an excitation frequency of the drill string.
Figure 4:
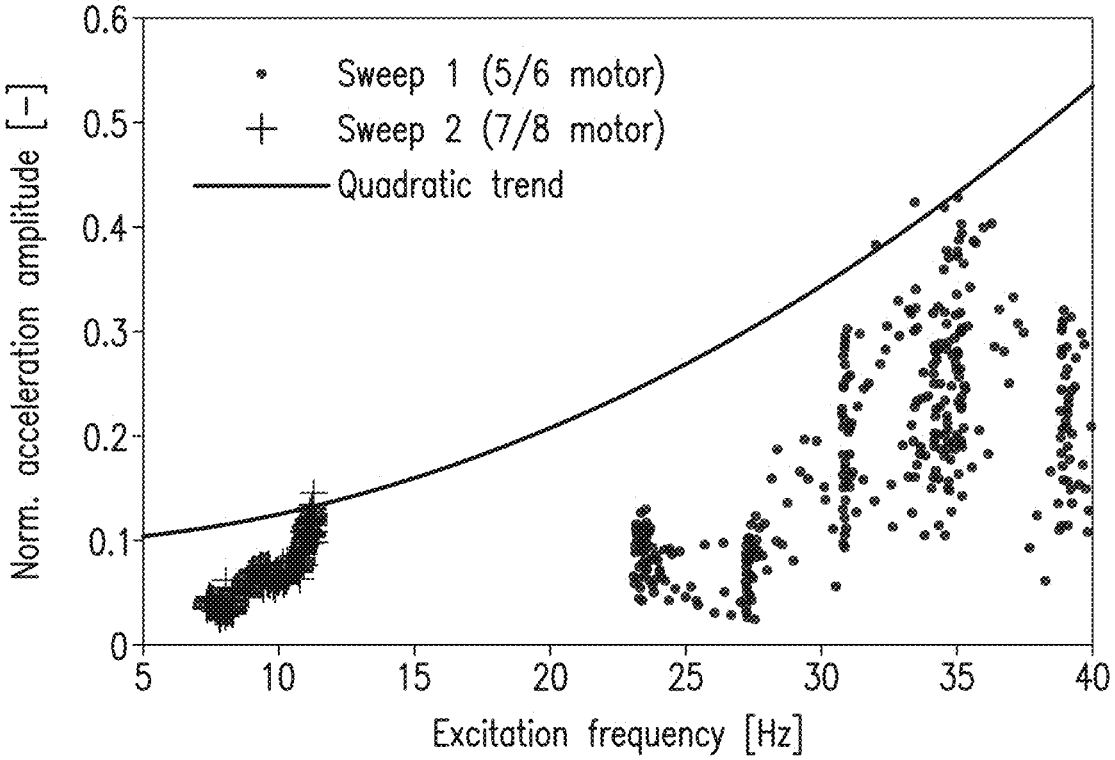
FIG. 4 depicts aspects of vibration amplitudes as a function of frequency.

FIG. 3 is a gray-scale plot of excitation frequency spectrum and corresponding value of vibration amplitude over time as the excitation frequency of a mud-motor is varied. Various eigenfrequencies can be determined from the amplitude peaks corresponding to the theoretical excitation frequency of the mud motor. FIG. 4 is a plot of vibration amplitude versus excitation frequency for the data in FIG. 3. In FIG. 3, the motor excitation frequency with z=7 can be identified. The flow rate or motor excitation frequency is decreased in steps from 45 Hz to 20 Hz (step sine excitation). A resonance can be identified at approximately 35 Hz. The measurement shows that acceptable drilling operation to increase ROP and limit severe vibrations is possible above 43 Hz and below 30 Hz. In FIG. 4, the black points belong to a spectrum of acceleration amplitudes. It shows a clear resonance peak at 35 Hz. Again acceptable drilling parameters can be identified. Limitations for the special case are a limited number of measurements points denoted by crosses and frequency range along the structure. For example, a resonance peak cannot be found if the corresponding mode shape has a node (i.e., zero acceleration) at the acceleration sensors or if the mode shapes are not excited by the motor. Resonance peaks outside the specifications of the flow rate and the corresponding frequency range cannot be found.

Various techniques may be used to identify modal parameter and vibrations. One technique is order analysis. In order analysis, the frequency content of time-based data such as accelerations is determined by a Fourier transformation (e.g., with a fast Fourier transform (FFT)). There is a trade-off between the length of the time intervals (good time resolution) and the resolution regarding the frequencies. The FFT is for example calculated for intervals of four seconds. The result is depicted in FIG. 3 and called a spectrogram. In the spectrogram, amplitudes at different multiples of the theoretical excitation frequency are determined (called order analysis) and depicted as a function of the frequency. For example, the rotary speed of the string and multiples of the excitation frequency of the mud motor are depicted in FIG. 4 along with multiples of this excitation frequency.

Further, transfer functions may be determined from excitation source to sensor or measurement device in order to determine mode shapes. The knowledge of the defined excitation source allows the calculation of transfer functions. One example of a transfer functions is the ratio of the Laplace transform X(s) of the time signal x(t) of the amplitudes and the Laplace transform of the loads F(s), H(s)=X(s)/F(s). Modal analysis techniques may also be used to determine modal damping, eigenfrequencies, and mode shapes from the transfer functions. Yet further, Luenberger observer, Kalman filter, modal analysis techniques, operational modal analysis, and the like may be used with or without a model of the drilling system (e.g., finite element model, analytical model, transfer matrices, finite differences model, and other models) to identify vibrational properties such as a eigenfrequency and a mode shape. Resonances and thus severe or damaging vibrations can be avoided from the analysis of identified properties.

Figure 5:
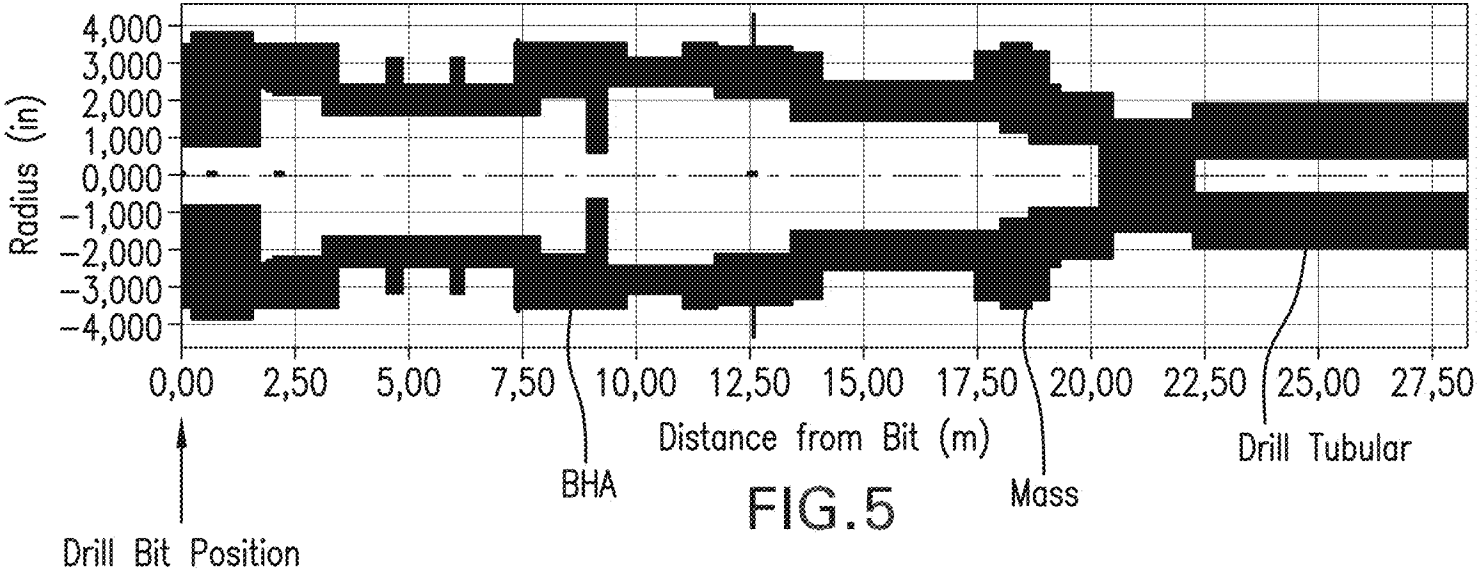
FIG. 5 depicts aspects of a mathematical model of the drill string.

FIG. 5 illustrates various mode shapes of the drill string. Natural vibration modes are referred to as eigenmodes. Nodes are those points on the drill string that do experience zero vibration or acceleration amplitude. Hence, in general, vibration sensors are not disposed at these points because they would sense zero or very low acceleration and would provide a useful vibration measurement or observability at the nodes. Mode shapes may be determined by vibration sensor readings, analysis, experience based on similar drill strings or some combination thereof. If a plurality of vibration sensors are disposed along the drill string, the mode shape and thus nodes can be determined by plotting the vibration sensor readings as a function of sensor location. It can be appreciated that a model used to place excitation sources and sensors may not be 100% accurate such as not taking into account all excitation sources (e.g., all borehole wall contacts). Hence, other locations for excitation sources and sensors may also be used in addition to the locations determined from the model. These other locations may be interpolated between the model locations to provide additional assurance of controllability and observability.

The excitation source that is used to excite a frequency spectrum can be placed at a location to excite the observed mode or mode shape. The modal force of an excitation source can be determined by the integral of the mode shape multiplied by the excitation source over the length of the drilling system. In a discrete model this is the scalar product of mode shape and excitation. In a formal way, criteria of controllability (i.e., location of excitation source to provide desired excitation force and mode shape) and observability (i.e., location of sensor or sensors to sense resulting vibrations due to the excitation force) can be used to determine suitable places for sensors and excitation sources for a mode.

Figure 6:
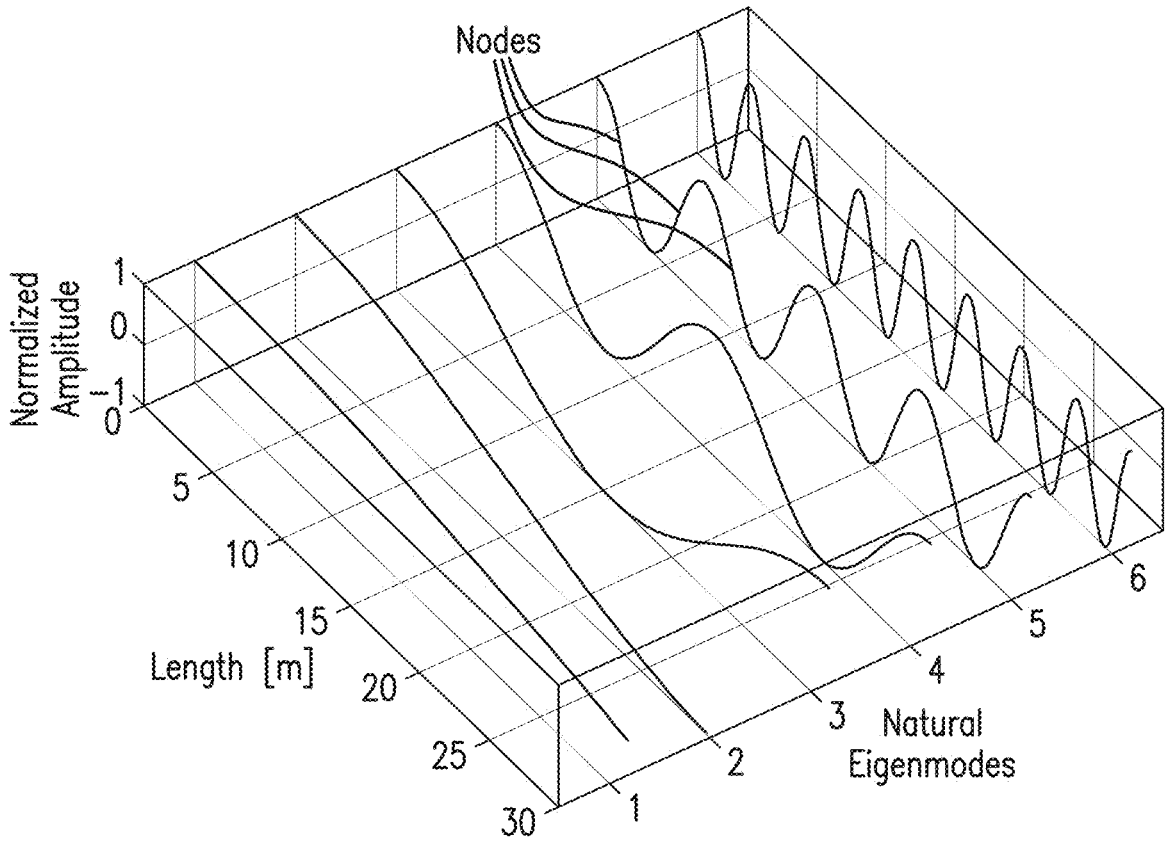
FIG. 6 depicts aspects of eigenmodes of the drill string.

For analysis, a mathematical model of the drill string that may include the BHA or other components is constructed. In one or more embodiments, the drill tubular is modeled as a finite-element network such as would be obtained using a computer-aided-design (CAD) software package. Non-limiting embodiments of the CAD software are Solid Works, ProEngineer, AutoCAD, and CATIA. The model may be a three-dimensional model, a two-dimensional model, or a one dimensional model (i.e., modeling just torsional vibration, just axial vibration, or just lateral vibration). The model includes a geometry of the drill string and material properties of the drill string such as density (e.g., to give weight distribution), stiffness (e.g., to determine flex), and/or damping characteristic. The stiffness data may include elasticity and/or Poison's Ratio. It can be appreciated that if a tool or component is configured to be a structural part of the drill string, then the tool or component will be modeled as part of the drill string. The model may also include geometry of the borehole so that external forces imposed on the drill tubular from contact with a borehole wall can be determined. The geometry may be determined from a drilling plan or from a borehole caliper tool, which may be one of the downhole tools 9. FIG. 6 illustrates one example of a mathematical model of the drill tubular having a BHA. In an alternative embodiment, a lumped mass model may be used. Once the mathematical model is constructed, an equation of motion is applied to the model to calculate the motion of the drill string.

Figure 7:
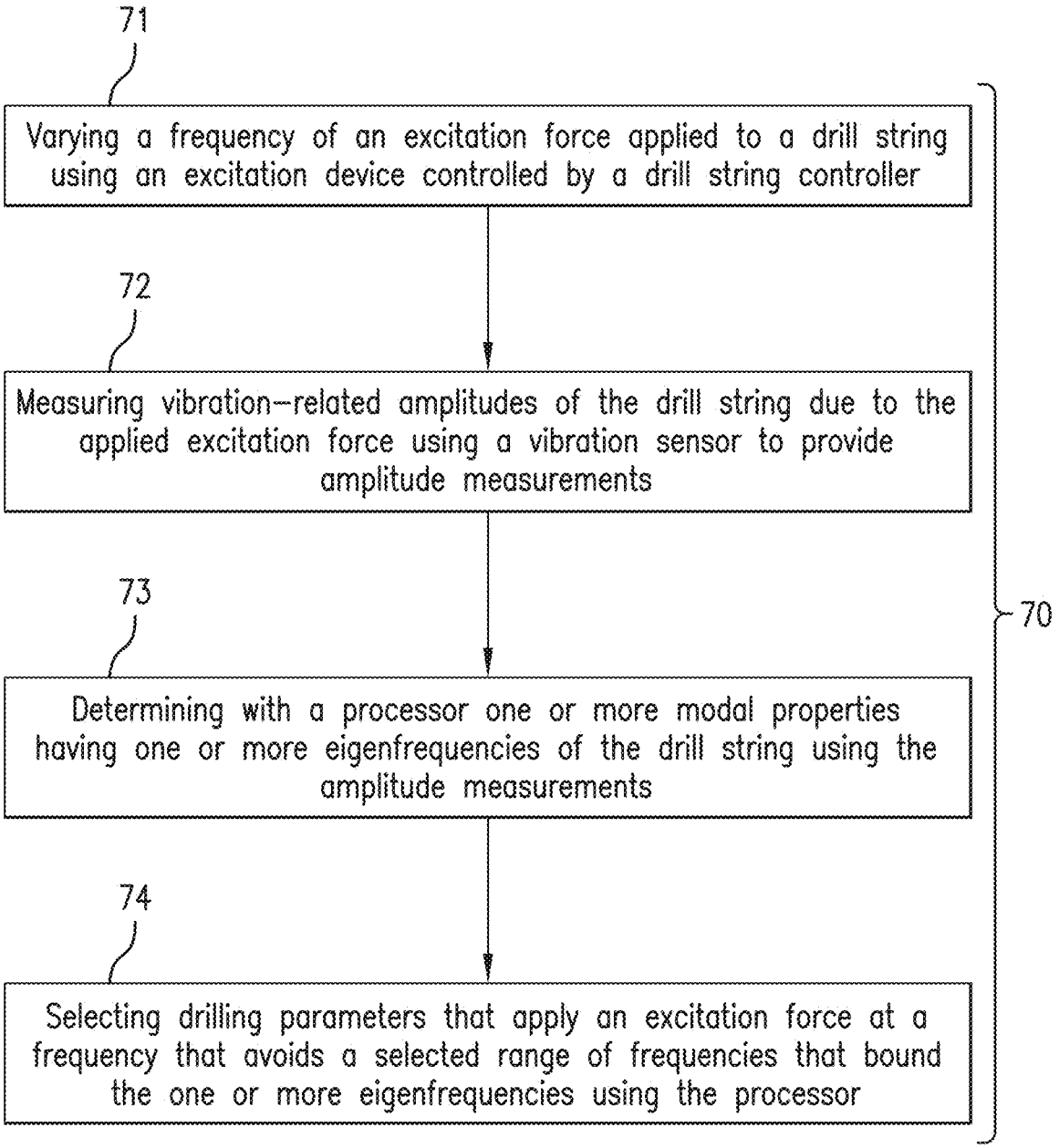
FIG. 7 is a flow chart for a method for selecting drilling parameters for drilling a borehole penetrating the earth with a drill string.

FIG. 7 is a flow chart for a method 70 for selecting drilling parameters for drilling a borehole penetrating the earth with a drill string. Block 71 calls for varying a frequency of an excitation force applied to the drill string using an excitation device controlled by a drill string controller. This step may also include varying a flow rate of drilling fluid through the drill string in order to vary the frequency of an excitation force applied to the drill string by a mud-motor. The flow rate may be varied by varying at least one of a drilling fluid pump speed and a drilling fluid flow valve. This step may also include keeping one or more drilling parameters not associated with the excitation force applied to the drill string constant while the frequency of the excitation force is varied. In general, the excitation device is disposed at a location that enables the excitation device to excite the drill string and thus provide controllability of the drill string. The excitation frequency may include at least one of torque, impact force, and/or position displacement. In one or more embodiments, the excitation device may include a plurality of excitation devices that are excited simultaneously, sequentially and/or some combination thereof. Block 72 calls for measuring vibration-related amplitudes of the drill string due to the applied excitation force using a vibration sensor to provide amplitude measurements. Non-limiting embodiments of the vibration-related amplitudes include vibration amplitude, deflection amplitude, velocity amplitude, and bending moment amplitude. In one or more embodiments, the sensor is disposed in a bottomhole assembly of the drill string. In one or more embodiments, the vibration-related amplitudes are measured in a frequency domain and/or a frequency domain. In one or more embodiments, the sensor represents a plurality of sensors that may be in one location or a plurality of locations distributed along the drill string. In one or more embodiments, the sensor or sensors are disposed at locations that are not nodes of a modal shape of the drill string. Block 73 calls for determining with a processor one or more modal properties having one or more eigenfrequencies of the drill string using the amplitude measurements. The modal properties may include a modal shape and/or modal damping. Block 74 calls for selecting drilling parameters that apply an excitation force at a frequency that avoids a selected range of frequencies that bound the one or more eigenfrequencies using the processor. By avoiding the selected range of frequencies, severe vibrations due to resonance of the drill string can be avoided. In general, the range of frequencies that bound the one or more eigenfrequencies is selected so that damage to the drill string is prevented. For example, operation of the drill string outside of the selected range provides for operation of drill string components within their operational specifications or design parameters. Stated in other words, the range to be avoided may be selected such that the drill string components would exceed their operational specifications or design parameters if operated within that range. Margins that encompass sensor error may be added to the selected range may be used to help insure that the drilling parameters do not cause resonant vibrations of the drill string.

The method 70 may also include drilling the borehole with a drilling rig using the selected drilling parameters in order to prevent or limit drill string vibrations. The method 70 may also include transmitting the selected drilling parameters to a drill string controller configured to control the drill string in accordance with the selected drilling parameters. The method 70 may also include controlling one or more drilling parameters using a feedback controller that receives input from a drilling parameter sensor in accordance with a signal received from a processor that selected the drilling parameters that avoid the eigenfrequencies. The signal includes one or more setpoints of drilling parameters that avoid the eigenfrequencies. It can be appreciated that the one or more setpoints can be transmitted to the drill string controller in real time as soon as sensor data is received and eigenfrequencies are determined.

The method 70 may also include constructing a mathematical model of the drill string comprising dimensions and mass distribution of the drill string; analyzing a response of the mathematical model to an excitation stimulus to provide the modal shape of the drill string; and determining a location of one or more nodes of the modal shape. The mathematical model may include a shape and dimensions of the borehole and the drill string being disposed in the borehole so that impacts with the borehole wall may be modeled.

The method 70 may also include applying a correction factor as determined by the analysis of the mathematical model to the measured amplitudes to determine a maximum amplitude of vibration of the drill string. The method 70 may also include (1) calculating a ratio of vibration amplitude at a location of the vibration sensor to the maximum vibration of the drill string at another location using the mathematical model and (2) calculating the maximum vibration amplitude of the drill string using the ratio and the vibration amplitude measurements obtained by the vibration sensor.

In support of the teachings herein, various analysis components may be used, including a digital and/or an analog system. For example, the mud-pulse telemetry system 100, the downhole tool 10, the downhole sensor 8, the formation tester 9, the mud-pulser 12, the modulator 14, the downhole electronics 15, the receiver 17, the transducer 19, the demodulator 29, the encoder 41, the decoder 48, and/or the computer processing system 16 may include digital and/or analog systems. The system may have components such as a processor, storage media, memory, input, output, communications link (wired, wireless, optical or other), user interfaces (e.g., a display or printer), software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured. The terms "first," "second," and the like do not denote a particular order, but are used to distinguish different elements.

The flow diagram depicted herein is just an example. There may be many variations to this diagram or the steps (or operations) described therein without departing from the spirit of the invention. For instance, the steps may be performed in a differing order, or steps may be added, deleted or modified. All of these variations are considered a part of the claimed invention.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for selecting drilling parameters for drilling a borehole penetrating the earth with a drill string having a drill bit, the method comprising:

varying a frequency of an excitation force applied to the drill string using an excitation device;

measuring vibration-related amplitudes of the drill string caused by cutting forces at the drill bit and due to the applied excitation force using an accelerometer to provide amplitude measurements;

determining with a processor one or more modal properties comprising one or more eigenfrequencies of the drill string using the amplitude measurements;

selecting the drilling parameters that apply the excitation force at a frequency that avoids a selected range of frequencies that bound the one or more eigenfrequencies using the processor; and controlling the drill string and/or drilling the borehole with a drilling rig based on the selected drilling parameters.

2. The method according to claim 1, wherein the excitation force comprises at least one selection from a group consisting of torque, impact force, and position displacement.

3. The method according to claim 1, wherein the vibration-related amplitudes are measured in at least one selection from a group consisting of time domain and frequency domain.

4. The method according to claim 1, wherein the one or more modal properties further comprise modal shape and/or modal damping.

5. The method according to claim 1, wherein varying a frequency of an excitation force applied to the drill string using an excitation device comprises varying at least one of a drilling fluid pump speed and a drilling fluid flow valve.

6. The method according to claim 1, further comprising keeping one or more drilling parameters not associated with the excitation force applied to the drill string constant while the frequency of the excitation force is varied.

7. The method according to claim 1, wherein the accelerometer is disposed in a bottomhole assembly of the drill string or on the drill string at a location other than in the bottomhole assembly.

8. The method according to claim 7, wherein the accelerometer comprises a plurality of accelerometers.

9. The method according to claim 1, wherein the accelerometer is disposed at a location that is not a node of a modal shape of the drill string.

10. The method according to claim 1, further comprising:

constructing a mathematical model of the drill string comprising dimensions and mass distribution of the drill string;

analyzing a response of the mathematical model to an excitation stimulus to provide the modal shape of the drill string; and determining a location of one or more nodes of the modal shape.

11. The method according to claim 10, wherein the mathematical model comprises a shape and dimensions of the borehole and the drill string being disposed in the borehole.

12. The method according to claim 11, further comprising calculating a ratio of a vibration amplitude at a location of the accelerometer to a maximum vibration of the drill string at another location using the mathematical model.

13. The method according to claim 12, calculating the maximum vibration of the drill string using the ratio and a vibration amplitude measurement obtained by the accelerometer.

14. The method according to claim 1, wherein the excitation device is located at a location that can excite the drill string.

15. The method according to claim 14, wherein the excitation device comprises a plurality of excitation devices and the excitation devices are excited simultaneously, sequentially or some combination thereof.

16. The method according to claim 1, wherein the excitation device comprises a mud-motor and varying the frequency comprises varying a flow rate of drilling fluid through the drill string.

17. A method for selecting drilling parameters for drilling a borehole penetrating the earth with a drill string having a drill bit, the method comprising:

constructing a mathematical model of the drill string comprising dimensions and mass distribution of the drill string;

analyzing a response of the mathematical model to an excitation stimulus to provide a modal shape of the drill string;

determining a location of one or more nodes of the modal shape;

disposing a plurality of accelerometers at locations along the drill string that are not nodes of the modal shape;

varying a frequency of an excitation force applied to the drill string using a plurality of excitation devices, the excitation force of each excitation device being applied simultaneously, sequentially or some combination thereof;

measuring amplitudes of vibrations of the drill string caused by cutting forces at the drill bit and due to the applied excitation force of each excitation device using the plurality of accelerometers to provide amplitude measurements;

determining with a processor one or more modal properties comprising one or more eigenfrequencies of the drill string using the amplitude measurements;

applying a correction factor as determined by the analysis of the mathematical model to the measured amplitudes to determine a maximum amplitude of vibration of the drill string;

selecting the drilling parameters that apply an excitation force at a frequency that avoids a selected range of frequencies that bound the one or more eigenfrequencies using the processor;

transmitting the selected drilling parameters to a drilling parameter controller configured to control the drill string in accordance with the selected drilling parameters; and controlling, using the controller, the drill string and/or drilling the borehole with a drilling rig based on the selected drilling parameters.

18. An apparatus for selecting drilling parameters for drilling a borehole penetrating the earth with a drill string having a drill bit, the apparatus comprising:

an excitation device coupled to the drill string;

a drilling parameter controller coupled to the excitation device and that controls the excitation device in order to vary a frequency of an excitation force applied to the drill string by the excitation device;

an accelerometer that measures amplitudes of vibrations of the drill string caused by cutting forces at the drill bit and due to the applied excitation force to provide amplitude measurements that are in a time domain and/or a frequency domain; and a processor configured to (i) determine one or more modal properties comprising one or more eigenfrequencies of the drill string using the amplitude measurements, (ii) select the drilling parameters that apply an excitation force at a frequency that avoids a selected range of frequencies that bound the one or more eigenfrequencies, (iii) transmit the selected drilling parameters to the drilling parameter controller configured to control the drill string and/or drill the borehole with a drilling rig based on the selected drilling parameters, and (iv) control, using the controller, the drill string and/or drill the borehole with a drill rig based on the selected drilling parameters.

19. The apparatus according to claim 18, wherein the processor is further configured to:

construct a mathematical model of the drill string comprising dimensions and mass distribution of the drill string;

analyze a response of the mathematical model to an excitation stimulus to provide the modal shape of the drill string; and determine a location of one or more nodes of the modal shape.

20. The apparatus according to claim 19, wherein a location of the accelerometer is not at a node of the modal shape of the drill string.

21. The apparatus according to claim 20, wherein the accelerometer comprises a plurality of accelerometers disposed at locations along the drill string that are not nodes of the modal shape.

* * * * *